US006198898B1

(12) United States Patent
Mabbott

(10) Patent No.: US 6,198,898 B1
(45) **Date of Patent: *Mar. 6, 2001**

(54) METHOD OF PRINTING MONOCHROME AND COLOR IMAGES ONTO A SURFACE

(75) Inventor: Robert John Mabbott, Bedford (GB)

(73) Assignee: ISO Developments Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 09/079,182

(22) Filed: May 14, 1998

(Under 37 CFR 1.47)

Related U.S. Application Data

(63) Continuation of application No. 08/454,334, filed as application No. PCT/GB93/02591 on Dec. 17, 1993, now Pat. No. 5,842,096.

(30) Foreign Application Priority Data

Dec. 18, 1992 (GB) ..... 9227187

(51) Int. Cl.[7] ..... G03G 15/01; G03G 13/01; G03G 15/16; G03G 13/16

(52) U.S. Cl. ..... 399/302; 156/235; 156/240; 430/47

(58) Field of Search ..... 399/302, 308, 399/341, 342, 298; 430/126, 47, 99, 124; 156/240, 241, 233, 234, 235; 101/33, 34, 487; 427/147, 148, 152

(56) References Cited

U.S. PATENT DOCUMENTS

| | | | | |
|---|---|---|---|---|
| 4,724,026 | * | 2/1988 | Nelson | 156/233 |
| 4,933,212 | * | 6/1990 | Gerstner et al. | 427/258 |
| 5,087,495 | * | 2/1992 | Nelson | 428/46 |
| 5,842,096 | * | 11/1998 | Mabott | 399/302 |

FOREIGN PATENT DOCUMENTS

| | | | |
|---|---|---|---|
| 2231533 | * | 11/1990 | (GB) . |
| 60-52861 | * | 3/1985 | (JP) . |

* cited by examiner

*Primary Examiner*—Joan Pendegrass
(74) *Attorney, Agent, or Firm*—Wilson Sonsini Goodrich & Rosati

(57) ABSTRACT

The invention is a process for printing full color images with no discernible loss of quality from an initial image carrier onto the surface of diverse media, including paper, card, cardboard, glass, metal, wood, plastics materials and fabrics and textile materials including knitted and woven materials. The process involves the use of polyethylene naphthalate film having special qualities for transferring the initial image from an initial surface on which it is provided onto the final surface. Techniques are discloses for enhancing transferred images.

16 Claims, 9 Drawing Sheets

METHOD OF PRINTING MONOCHROME AND COLOR IMAGES ONTO A SURFACE

This application is a continuation of application Ser. No. 08/454,334, filed Jun. 16, 1995, U.S. Pat. No. 5,842,096, which is a 371 of PCT/GB93/02591, filed Dec. 17, 1993.

BACKGROUND AND SUMMARY OF THE INVENTION

This invention is concerned with improvements in or relating to the formation by printing of images on diverse media, including paper, card, cardboard, glass, wood, metal, metallised materials, plastics materials, film form materials and fabrics and textile materials including closely-woven and knitted materials whether or not the surfaces of those materials are plain or have existing artwork thereon.

Attempts to transfer and so print images have been made previously but until now there has not been a successful attempt to transfer full colour images from one surface to another without the use of intermediate means such as adhesive materials and without loss of definition or colour tones or image quality.

UK patent specification no. 1215599 discloses a method of reproducing images on objects unsuitable for passage through an electrostatic copying machine, comprising: passing a sheet of material through a xerographic copying machine so that charged particles are distributed over the sheet of material in a pattern corresponding to the image to be reproduced; heating the sheet to cause the particles to adhere to the sheet; and subsequently placing the image-bearing surface of the sheet in contact with a further surface on which the image is required to be reproduced and applying heat and pressure to the said contacting surfaces until the particles transfer from the said sheet to the said further surface and fuse to the latter whereby on separation of the surfaces the fused pattern of particles is exposed on the said further surface. The method is said to be useful in forming images on surfaces of metal, glass, tiles, wood and fabric, and for forming transparencies such as overhead projection (OHP) foils.

The specific description refers to the use of a film material which may be a triacetate film or a proprietary film known as 'Melinex' film (MELINEX is a Registered Trade Mark of ICI Ltd.), heated during image transfer to a temperature between 80° C. and 100° C.

On page 2 at liens 4 to 8 of the aforesaid UK patent specification, it is stated that 'It is of course unnecessary for all the particles on the sheet to transfer to the surface on which the image is to be reproduced; it is sufficient if a substantial proportion of the particles is transferred', which is, of course, suitable for the purposes for which the invention was intended, namely the production of acceptable monochrome images in cases where the precision of image is not critical, but not for the clarity and definition of full colour images such as can be achieved by the present invention.

In U.S. Pat. No. 4,006,267, the invention is concerned with a method of colour highlighting an image on a xerographically produced copy by superimposing a colourant layer onto a monochrome image from a transfer donor, of Mylar film (MYLAR is a Registered Trade Mark of du Pont Corporation) or Lexan film (LEXAN is a trade mark of General Electric Company).

This disclosure describes the addition of colour to an existing monochrome image to provide background colour only. It does not teach the transfer of full colour images such as can be achieved by the present invention.

European patent application no. 191592 discloses a process of transferring metallic foils onto xerographic images which comprises a selective transfer process characterised by the steps of: providing a receiving substrate comprising xerographic images and a foil transfer sheet; placing the receiving substrate comprising xerographic images in face-to-face contact with the foil transfer sheet, to form a sandwich with the xerographic images on the inside; applying heat and pressure to at least one of the receiving substrate and the foil transfer sheet to cause the xerographic image to become tacky and the foil to selectively adhere to the images, resulting in a decorated receiving substrate; and stripping the foil transfer sheet away from the decorated receiving substrate.

In carrying out a process according to the invention disclosed in this European patent application, adhesive material is employed to transfer the xerographic images formed on paper to a receiving substrate which comprises a multi-layer assembly which may include a layer of metallic foil and/or a coloured layer so that the transferred images are positioned on a decorative background (ie. the receiving substrate). The use of adhesive material normally creates a 'frame' which is undesirable where a clean image is required.

However, there is no disclosure which teaches the transfer of full colour images as taught by the present invention.

Polyethylene naphthalate (PEN) film has existed for a number of years and was developed in film form for use in a number of applications including uses such as overhead projection foils or films and insulation on printed circuit boards.

In European patent application no. 222374, there is disclosed such an application of the use of PEN film. In this particular publication, there is described and claimed a film form polyethylene 2,6-naphthalate film, of thickness 0.5 to 6 microns, which has a thermal transfer layer coated on one of the surfaces of the film. The film is described as being dimensionally stable. The method of printing using this film form material is that referred to as thermal transfer printing in which the thermal transfer layer is placed while supported by the PEN film against a paper sheet while a thermal head is used to soften the material of the layer to an extent that it is transferred to the paper sheet thereby to form characters or images.

This European patent application further states (q.v. page 4) that by using three separate PEN films each having a layer of a primary colour thereon, it would be possible to build up an image on the paper sheet which is in full colour.

However, the specification of this application does not say how this would or could be achieved and the specific examples to which reference is made refer only to a typewriter ribbon made from material as claimed (q.v. p.15). Certainly, if a full-colour and complete image transfer could have been achieved on a commercial scale, then it would, because there always has been a demand for a solution to full colour transfer even if it had been a multi-stage operation of laying down each primary colour in turn.

In Japanese published application no. 62-11695, filed on Nov. 16, 1985 by Diafoil Kabushiki Kaisha, there is disclosed film for use in electronic photography which is provided by polyethylene-2,6-naphthalate film described as having a maximum specific shrinkage factor and a minimum lengthwise and transverse Young's modulus. The film is claimed to have a thermal stability and other properties which permit it to be used to form over head projection (or OHP) films which can be fed from a stack into a photocopier.

In the published application the OHP film is described as being either a transparent film on its own or, when transfer qualities are required, as being coated by application of 'a water system dispersing agent or water soluble resin having adhesive qualities . . . '. It is further stated in relation to the Practical Embodiment 1 disclosed in this publication, that a PEN film of 50$\mu$ thickness was evaluated using a Canon pc-10 dry electronic monochrome photographic copier (q.v. page 4). As recounted from the results of Table 2, where the film was fed through the copier from a stack, on a scale of 0 to 5 where 5 represents optimum results, toner transfer was rated as 4 (q.v. page 5). Such results do not indicate the way to full colour, complete, image transfer.

More recently than any of the above prior publications, a recent development by Minolta has been announced in which it is alleged that colour pictures and illustrations can be transferred onto 'virtually any material'. This development relies upon the forming of an original image on a 'special transparent plastic sheet' onto which a bonding agent is sprayed over the image and the surface of the transparent plastic sheet. The image is then transferred by pressure onto the surface of the material intended to carry the image.

This system is described as operating in a fashion similar to that of a instant lettering system in that the image is transferred by rubbing the rear surface of the plastic sheet so that the bonding agent or adhesive is transferred to the material with the image bonded thereto.

This system demands the use of adhesive with the attendant disadvantages associated therewith and referred to above.

A further recent development has been suggested by Warner MDS Color of Salt Lake City, Utah, U.S.A., in which a toner image created in a photocopier can be transferred onto aluminium printing plates from plastic sheet material onto which the toner is copied initially. However, this development is only useful with black toner and has been primarily designed for use in the printing industry.

In none of the prior art known to the applicant is there any suggestion, other than in published UK patent application 2231533A discussed below, that any of these disclosures could be used for or result in the complete transfer of a full colour image onto a desired substrate as can be performed by a method according to the present invention. In fact, the prior art appears to accept from the provision of colour-enhanced images, that obtaining transfer of full colour images was not hitherto achieveable.

Certainly, the only attempt to do so was not successful because it did not achieve acceptable complete image transfer nor could it.

In the specification of UK patent application no. 2231533 (now abandoned), it was proposed to form artwork by a method which comprised the steps of generating xerographically a right-readable image on a surface of a transfer medium (i.e. a silicone coated sheet), and transferring the image, as a mirror image, onto an intermediate carrier (notably of polyethylene terephthalate film material) under heat and pressure, pressure being applied by a hand held roller having a surface temperature of 'about 160 degrees Celsius'. The image was then reported to be finally transferred as a right readable image onto the surface onto which it was to be finally applied by application of heat and pressure as before.

The aforementioned application was abandoned and it is known to the present applicant that it was so abandoned because such results as were achieved were not of commercially acceptable quality. An example of a transferred image produced by carrying out the method as described in the aforementioned specification is shown in FIGS. 1A–D of the accompanying drawings. In carrying out the method to produce this image, a grid was copied onto an intermediate carrier of film form polyethylene terephthalate material of 23 microns thickness (such material is available from ICI plc under its trademark 'Melinex' as 'Melinex' S general purpose film). The film was heated, as the initial image was transferred to and from it, to 160 degrees Celsius. It was found that there was very measurable distortion of the image which became more marked towards the bottom of the image but which was shown to exist both laterally and vertically of the image, being very marked in the bottom right-hand part of FIGS. 1A–D.

The present applicant is also aware that the use of polyethylene terephthalate film under various conditions did not produce a clear image transfer at any stage.

In contrast, it has now been discovered that the use of film form material comprising polyethylene ester material (hereinafter referred to as film form polyethylene ester material) having shrinkage characteristics of less than 1.0% (preferably 0.8%) not only allows the problem of distortion to be overcome but also allows transfer of full colour images to be effected onto a desired suitable surface. From trials which have been carried out, it has been discovered that the only commercially viable suitable polyester material currently available is polyethylene naphthalate material, a suitable form of which is available from ICI plc under its trade mark 'Kaladex' as 'Kaladex 2000' film. Of the Kaladex range of film form materials, it has been found that Kaladex 2000 film form material has all of the characteristics which make it suitable for carrying out a method according to the present invention.

Comparative results from using film form material comprising polyethylene napththalate material (hereinafter referred to as film form polyethylene naphthalate material) can be seen from FIGS. 2A–D of the accompanying drawings wherein is shown the same image as is shown in FIGS. 1A–D but produced by carrying out a method according to the present invention. As can be readily seen, the image transfer carried out by the present invention shows no distortion and is as sharp and well defined as the initial image from which the transfer was made.

The present invention provides a method of printing monochrome and full colour images onto a surface, the method comprising the steps of (a) copying the image onto a first image carrier to provide a toner image on the first image carrier;

(b) placing the first image carrier against a second image carrier with the toner image between the first image carrier and the second image carrier, the second image carrier having a greater affinity for the toner than the first image carrier when the toner is heated and being formed from a material selected from the group consisting of a film form polyethylene ester material having a thermal shrinkage characteristic of less than 1% or a film form polyimide material;

(c) heating the first and second image carriers, with the toner image therebetween, under pressure;

(d) thereafter removing the first image carrier from the second image carrier, with the toner image wholly transferred to the second image carrier;

(e) placing the second image carrier against a surface of a substrate, onto which the toner image is to be ultimately transferred, with the toner image therebetween, the substrate having a greater affinity for the toner than the second image carrier;

(f) heating the second image carrier and the substrate, with the toner image therebetween, under pressure; and (g) thereafter removing the second image carrier from the substrate, with the toner image wholly transferred to the substrate.

In performing step (c), the first and second image carriers, with the toner image therebetween, are preferably subjected to a temperature in the range of 140–160 degrees Celsius, e.g. by passing the first and second image carriers through a heating station, under pressure.

In performing step (f), the second image carrier and the substrate, with the toner image therebetween, are preferably subjected to a temperature in the range of 140–160 degrees Celsius, e.g. by passing the second carrier and the substrate through a heating station, under pressure.

In carrying out a method as set forth in any one of the last three immediately preceding paragraphs, step (c) is preferably carried out by passing the first and second image carriers through a heated roller unit to heat the toner image to a temperature in the range of 140–160 degrees Celsius.

In carrying out a method as set forth in any one of the last four immediately preceding paragraphs, step (f) is preferably carried out by passing the second image carrier and the substrate through a heated roller unit to heat the toner image to a temperature in the range of 140–160 degrees Celsius.

In carrying out a method as set forth in either one of the last two immediately preceding paragraphs, the heated roller unit in each case may comprise a single heated roller and a complementary roller. Alternatively, the heated roller unit in each case comprises a pair of heated rollers.

As an alternative arrangement to the method described in any one of the last three immediately preceding paragraphs, heating of the first and second image carriers may be carried out by a temperature controlled heating bar fixed in position so that the image carriers are drawn past the bar while pressure is applied to the combination by the bar. Similarly, heating of the second image carrier and the substrate may be carried out by a temperature controlled heating bar fixed in position so that the second image carrier and the substrate are drawn past the bar while pressure is applied to the combination by the bar.

In a further alternative arrangement, heating of the first and second image carriers is carried out by a temperature controlled heating bar which is moved to apply heat and pressure to the two image carriers. Similarly, heating of the second image carrier and the substrate may also be carried out by a temperature controlled heating bar which is moved to apply heat and pressure to the second image carrier and substrate.

In carrying out a method according to the present invention, and during step (c), it is preferred that the first image carrier and the second image carrier are subjected to a temperature in the range 150–155 degrees Celsius.

It is also preferred that, during step (f), the second image carrier and the substrate are subjected to a temperature in the range 150–155 degrees Celsius.

In carrying out a method according to the present invention, the temperature was measured using a Robin 3208K thermocouple Type K with a probe sensor which was calibrated at 100 degrees Celsius. The indicated temperature range of 150–155 degrees Celsius referred to in the last two immediately preceding paragraphs was that indicated by the thermocouple and reference to this range of temperatures must be understood in this context, having regard to the tolerances of the thermocouple.

According to another aspect of the invention, and as an alternative to a polyethylene ester material, it has been found that it would theoretically be possible to use a film form polyimide material which has closely similar characteristics of shrinkage and thickness to those of the polyethylene ester material. There are film form polyimide materials which are available but these are formed as cast materials and have a very low surface roughness; only a few are suitable. It has been found that a suitable polyimide material is that which is commercially available under the trade mark UPILEX.

However, any polyimide material which is suitable is currently prohibitively expensive to the extent that it could not be useful commercially to carry out a process analogous to the present invention and that there is currently no justification or reason for using polyimide materials on economic or any other grounds as an alternative to traditional full-colour printing techniques, including offset litho techniques, in contrast to the use of polyethylene naphthalate film which reduces the cost of full colour printing, especially where short runs of copies are required, to considerably less than the cost of employing traditional techniques. This prohibitive cost of polyimide film was one justification for extensive research in seeking an alternative and commercially viable material.

The preferred polyethylene ester material is a film form polyethylene naphthalate material having a surface roughness ($R_a$) of the order of about 30 nm–35 nm, and more preferably 31.0 nm to 34.0 nm.

According to a further aspect of the present invention, the first image carrier is a high release material which may be a paper having a high release coating or sizing agent thereon, or alternatively may be a high, medium or low density polyethylene coated paper or a paper provided with a coating chromium, such as is known in the manufacture of magnetic recording tapes. Due to the flexibility of silicone coatings in use, the coating is preferably a silicone based coating. The paper may be of a weight in the range 80 to 160 $gm/m^2$; it has been found in carrying out experiments that papers of weight 90 $gm/m^2$ and 140 $gm/m^2$ have provided excellent results.

Preferred high release materials comprise 90 $gm/m^2$ and 140 $gm/m^2$ clay-coat craft paper provided on one surface with a solventless emulsion silicone coating, generally of a type used in coating release paper, label stock and release liners for adhesive tapes. Examples of such papers are those currently available from I.S.O. Developments Limited of Sandy, England as their CC90 and CC140 paper.

The characteristics of the film form polyethylene naphthalate material which have been identified as making the material suitable for use in transferring an image are that the surface exhibits an affinity for the toner particles which is greater than that of the high release characteristics of the high release substrate and so causes the toner particles to transfer to the film under the correct conditions of heat and pressure. It has been found that, within the range of 140–160 degrees Celsius, polyethylene naphthalate film possessing the characteristics stated above permits complete transfer of the toner from the initial high release carrier to the film across the entire colour range.

A further characteristic of the film is that it must exhibit less affinity for the toner particles than other surfaces to which the image is to be transferred under the correct conditions of heat and pressure. Again, it has been found that, within the range 140–160 degrees Celsius, the polyethylene naphthalate film having those same characteristics mentioned above permits complete transfer of the toner from the film to other surfaces including of paper, card, cardboard, glass, wood, metal, metallised surfaces, plastics materials and other film form materials, and fabrics and textile materials.

In addition to being dimensionally stable as mentioned above, it has been found that film form polyethylene naphthalate material has sufficient thermal stability to be useful within the range of temperatures at which the material can be used for effecting image transfer.

Furthermore, the preferred film form polyethylene naphthalate material is transparent thus allowing correct visual registration of an image on the material on an 'underlying' surface of the substrate onto which the image is to be transferred.

It has also been found that the transfer characteristics of the aforementioned film form polyethylene naphthalate material are such that it is possible to intensify a full colour image formed on a surface by carrying out a method according to the present invention and then repeating the process by overlaying a second identical image onto the first, due to the dimensional stability of the film, without damaging the integrity of the first image formed on the surface.

A film form polyethylene naphthalate material as aforesaid having a thickness of the order of 25 microns is most suitable for the purposes of carrying out a method according to the present invention although other thicknesses can also be used.

Where used herein, the term film form polyethylene naphthalate material includes, as the most preferred material, polyethylene-2, 6-napthalene dicarboxylate, biaxially oriented, heat set film, including, inter alia, filler and stabiliser material, the thermal stability of which film, as characterised by film shrinkage at 170 degrees Celsius for 30 minutes is measured as (MD) <0.8% and (TD) <0.8%, where MD means machine direction and TD means transverse direction. An example of such a material is 'Kaladex' 2000. It is believed that it is the surface roughness of the preferred polyethylene naphthalate material which enhances the excellent toner transfer characteristics, the roughness ($R_a$) being measured as 31.0 nm–34.0 nm. It is believed that this feature, in combination with the mechanical and thermal stability of the material, gives rise to the performance which has been observed when carrying out a method according to the present invention.

From experiments which have been carried out employing a method according to the invention, it has been observed that there is a full and complete image transfer onto whatever substrate is selected with no loss at all in image quality or in change of contrast, hue or texture in the colours of the transferred image.

A method according to this invention enables the use of a variety of image enhancement techniques for the toner image, depending also on the optical properties of the materials used. Toners, according to their colours, may be more or less transparent or translucent to light and images can be altered or enhanced accordingly. By the deposition of additional layers of toner or other materials having the desired optical properties selectively over the entire image surface, onto toner alone, or onto defined regions of the image surface or of the toner, a wide variety of effects can be achieved.

The layers having the desired optical properties can be conveniently deposited from appropriated-constructed commercially-available film form materials. In their simplest form, these film form materials comprise a backing sheet of thin polyester film with a coating of clear, heat-activated release agent supporting the layer in question. With the film form material correctly positioned over the toner image on the target surface, heat and pressure are applied to transfer the layer from the backing sheet to the target surface. Suitably, the described heated roller arrangement can be used for this purpose. The backing sheet is then simply peeled away.

One example of a commercially available film form material to be used in this manner is one for the purpose of changing the colour or appearance of a particular toner image. A transfer foil typically has the construction:

Polyester carrier film (12 micron)
Clear heat-activated release agent
Clear lacquer
Pigment layer(s)
Heat-activated adhesive The properties of the heat-activated release agent and adhesive are carefully selected such that, at the chosen values of heat and pressure, the pigment layer is deposited upon regions of exposed toner but not elsewhere. The clear lacquer then forms the upper surface and gives a gloss finish. Of course, the lacquer layer can be omitted if a matt finish is required. The pigment layer will typically be a homogeneous layer also including extenders and heat-activated adhesive which may supersede the adhesive layer per se in some instances.

Using a PEN transfer film it is possible, for example, to colour a black toner image in a similar manner to that described in the aforementioned European patent application no. 222374 and in the aforementioned U.S. Pat. No. 4,006,267 or to change the colour of a colour toner image which has been already formed. In a case where monochrome colour separations are available (similar to that disclosed in European patent application no. 222374), successive monochrome toner images can be transferred and with the use of a correctly pigmented layer, changed to the correct colour of the separation. In this way, it will be possible to generate a colour toner image from the output of an entirely monochrome printing or copying process. More generally, the optical properties of a transferred toner image can be widely varied and not merely through a change of colour. A metallic foil may—for example—be employed to increase the reflectivity of a toner image. A typical commercially available metallic foil construction is:

Polyester carrier film (12–12 microns)
Clear heat-activated release agent
Translucent coloured lacquer
Vacuum deposited aluminium
Heat-activated adhesive.

In many cases, it will be useful to be able to change the properties of the uppermost toner layer whilst leaving undisturbed one or more underlying layers. This is achieved in carrying out a method according to the present invention by sealing the underlying layer or layers with a lacquer, prior to transfer of the toner layer which is to be enhanced. Conveniently, a lacquer coating can be deposited using the foil technique, described above. Thus a suitable foil has the construction:

Polyester carrier film
Clear heat-activated release agent
Clear lacquer
Heat-activated adhesive The manner of use of the lacquer foil is as described above. Once a lacquer coating has been applied, toner layers beneath the lacquer are "fixed" and will not be affected by subsequent processes.

The lacquer layer may comprise translucent dye material to achieve whatever colour is desired of the lacquer layer.

It has been described how the optical properties of any one or more toner layers can be enhanced by the deposition of appropriate lacquers, pigments or metallic films over the toner layer. The present invention also contemplates the deposition of image enhancement layers beneath a particular toner layer, whilst still being confined to the regions of the image where toner is present. This is achieved, ingeniously, by the deposition of the appropriate enhancement layer (conveniently still using the described foil technique) on top of the toner layer, whilst the toner layer remains on the polyethylene ester transfer film. Then, when the process is completed with the transfer to the target surface, the image enhancement layer is beneath (i.e. backing) the toner layer.

One application of this backing technique is to transform a transparent image into an apparently solid image, for example by the addition of a white backing layer. The image can be transferred to a target surface of any colour, without the danger of contrast being lost. It will be recognised that the backing layer extends uniformly over the toner image, filling in small gaps between toner regions. This feature provides a second application of the backing technique, which is to increase the quality of an image by depositing black (or the appropriate colour) behind a region of black toner which through imperfections in the original copying process, is not as uniform as is very frequently required.

The foils which are suitable for the backing technique are similar to the transfer films described above. They share the property, for example, that, due to the presence of release agent, they do not adhere to areas which are totally free of toner. Foils for backing must, however satisfy the additional criterion that the upper surface of what is deposited must adhere well to the target surface. A suitable backing foil construction would be:

Polyethylene ester carrier film

Clear heat-activated release agent

Pigment layer (usually black or white)

Heat-activated adhesive

It will be seen that the uppermost layer, after deposition, is the pigment layer and not a lacquer.

Another family of techniques employs foils which adhere uniformly over the entire substrate and not merely to toner regions. These base foils are typically used to apply a pigment or metallic layer to a target substrate prior to the transfer of toner layers. Masking can be employed, however, so that a base layer is deposited on top of defined regions of a toner image providing—for example—a contrasting border or frame for the image.

The present invention also provides a method of printing monochrome and full colour images onto a surface, the method comprising the steps of (a) copying the image onto a carrier to provide a toner image on the carrier, (b) placing the carrier against film form polyethylene ester material with the toner image between the carrier and the material, (c) passing the carrier and the material through a heating station whereat, under pressure, the carrier and the material, with the toner image therebetween, are subjected to a temperature in the range of 140–160 degrees Celsius, (d) thereafter removing the carrier from the material, with the toner image wholly transferred to the material, (e) placing the material against a surface of a substrate onto which the toner image is to be ultimately transferred with the toner image therebetween, and (f) passing the material and the substrate through a heating station whereat, under pressure, the material and the substrate, with the toner image therebetween, are subjected to a temperature in the range of 140–160 degrees Celsius to transfer the toner image from the material to said substrate, the polyethylene ester material having thermal shrinkage characteristics of less than 1.0%.

According to another aspect of the present invention, there is provided apparatus comprising heating means and pressure applying means for use in and when working in accordance with a method according to the present invention. In the embodiment in which the method comprises passing materials through a heated roller unit, apparatus according to the present invention comprises the roller unit and control means for controlling power supply to one or both of the rollers for heating and rotating the rollers and for controlling the pressure applied at the nip of the rollers.

DETAILED DESCRIPTION OF THE PREFERRED EMBODIMENTS

Figure 1:
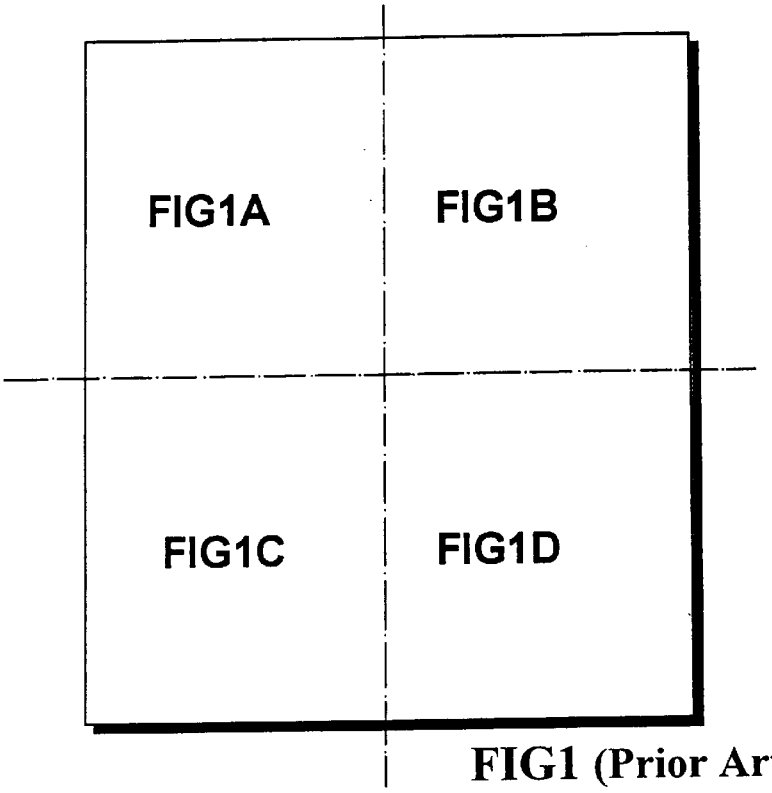
FIG1 (Prior Art)
FIG. 1 of the accompanying drawings is a small scale overview illustrating how the partial views of FIGS. 1A–1D are combined to form a whole image.
Figure 2:
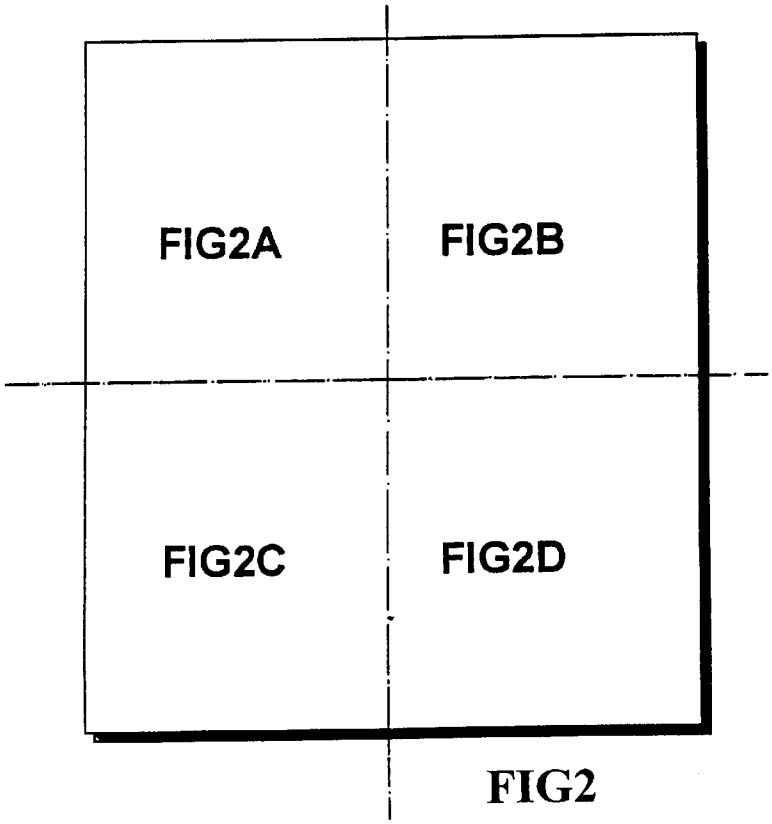
FIG. 2 of the accompanying drawings is a small scale overview illustrating how the partial view of FIGS. 2A–2D are combined to form a whole image.
Figure 1A:
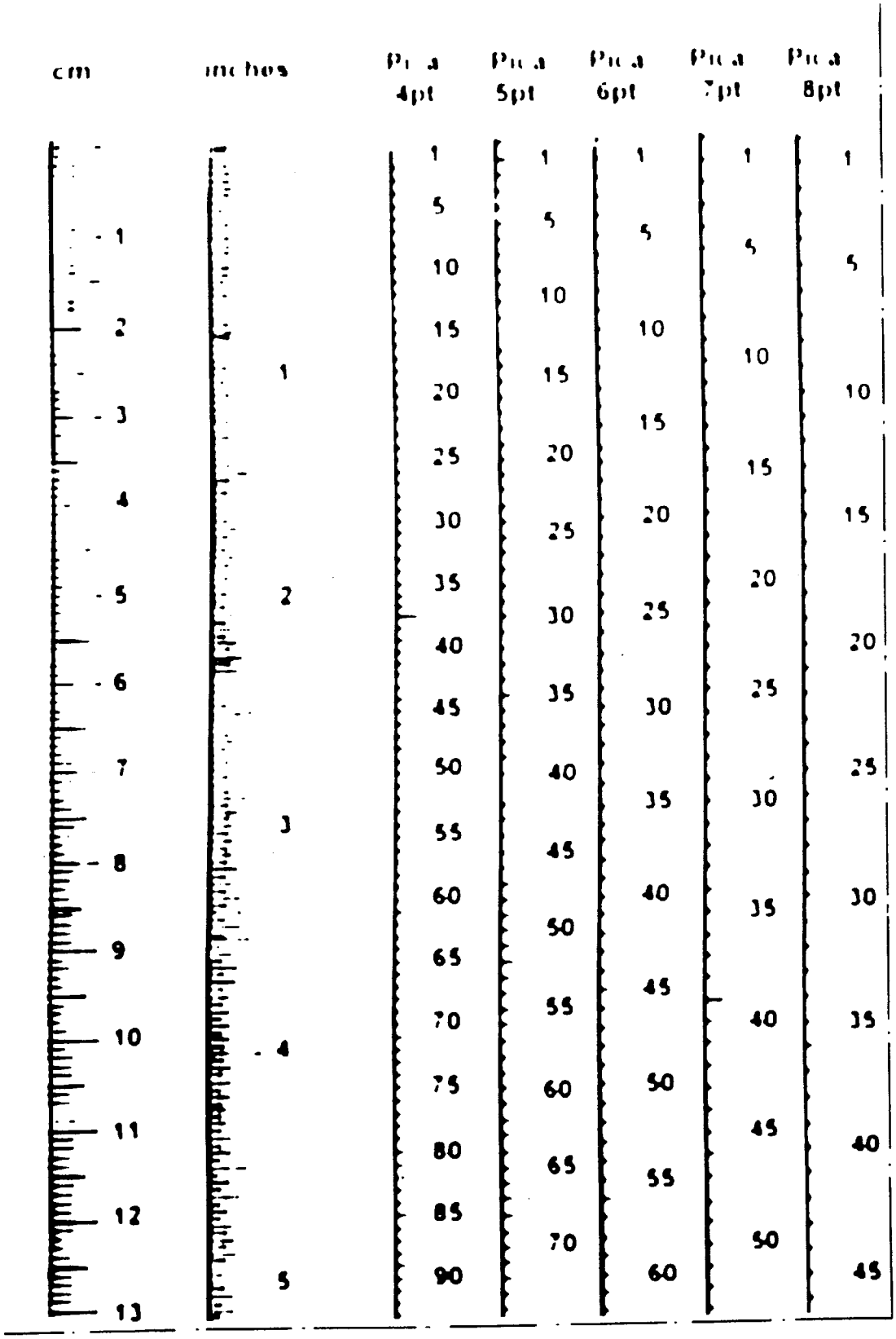
FIG1A (Prior Art)
FIGS. 1A, 1B, 1C and 1D of the accompanying drawings which have been referred to above are top left, top right, bottom left and bottom right partial view of a reproduction of an image made by using a prior art method of image transfer.
Figure 1B:
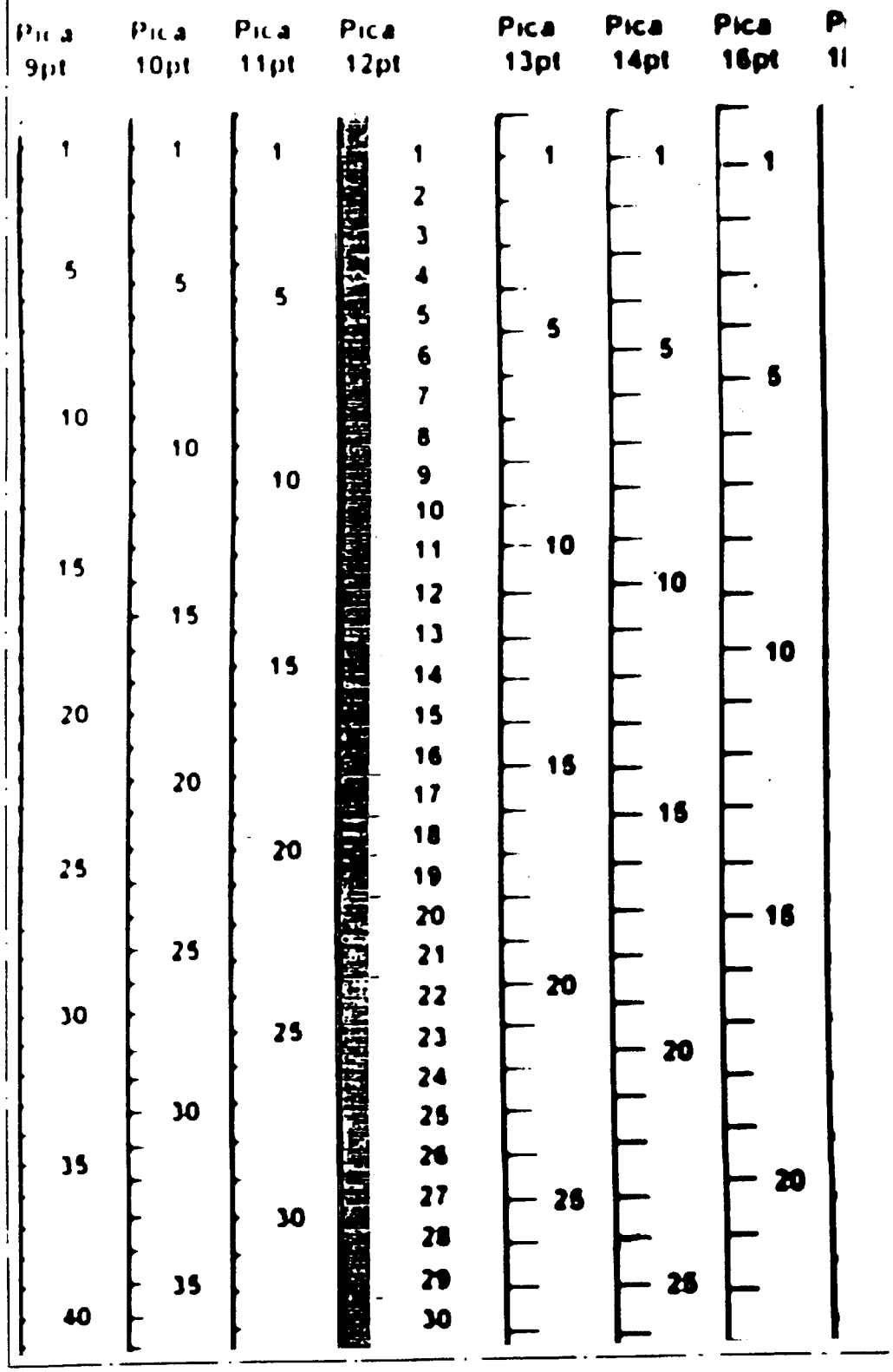
FIG1B (Prior Art)
Figure 1C:
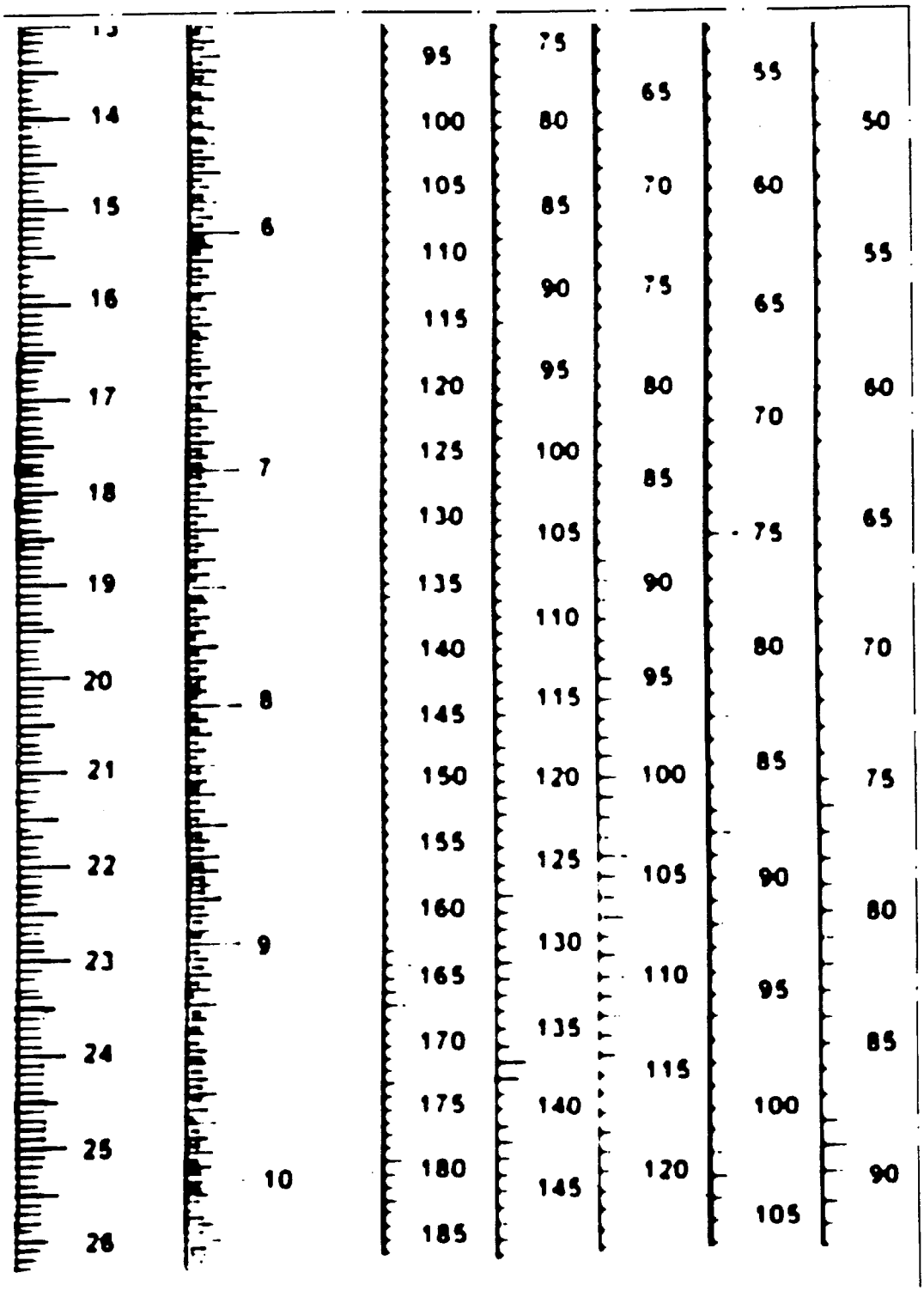
FIG1C (Prior Art)
Figure 1D:
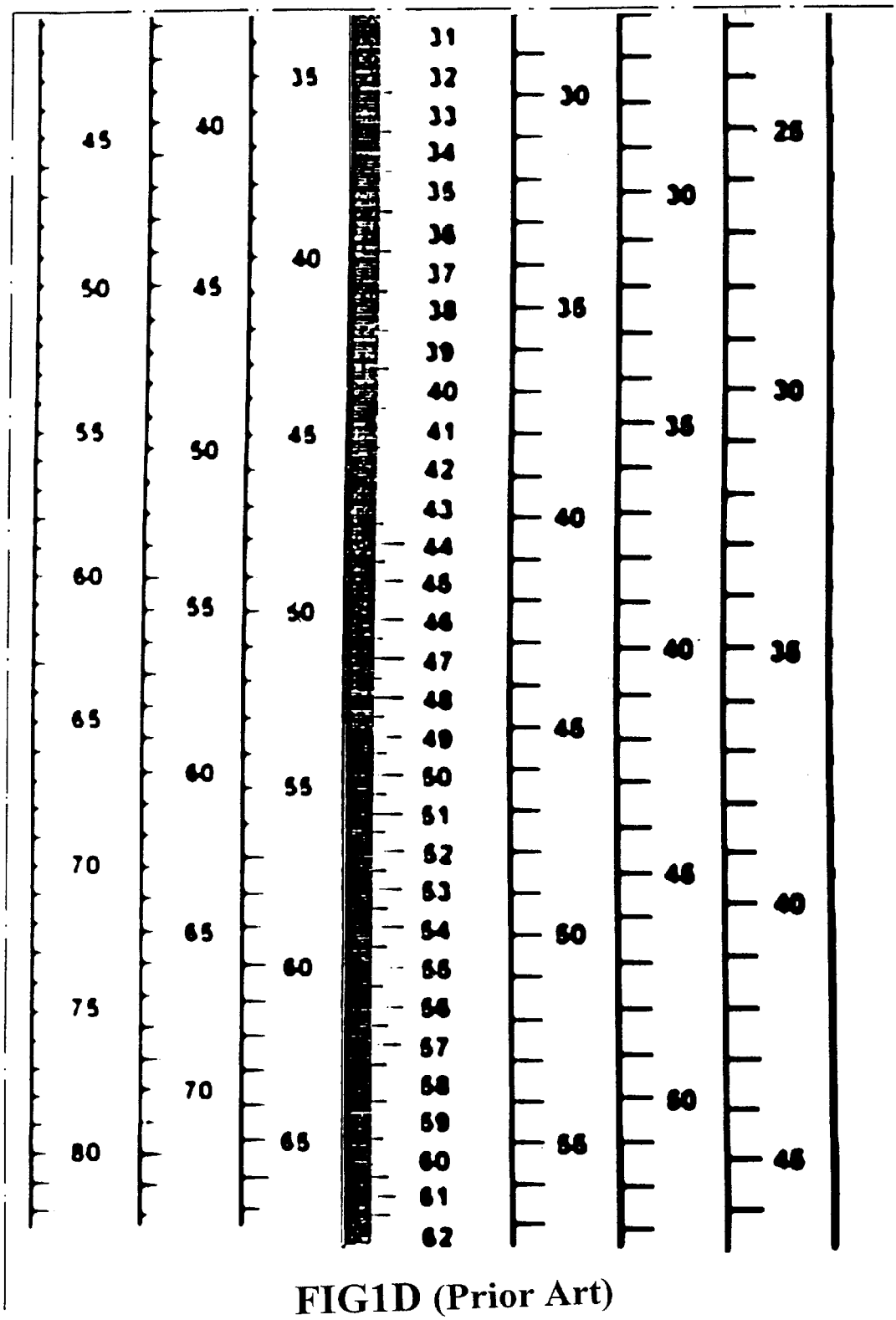
FIG1D (Prior Art)
Figure 2A:
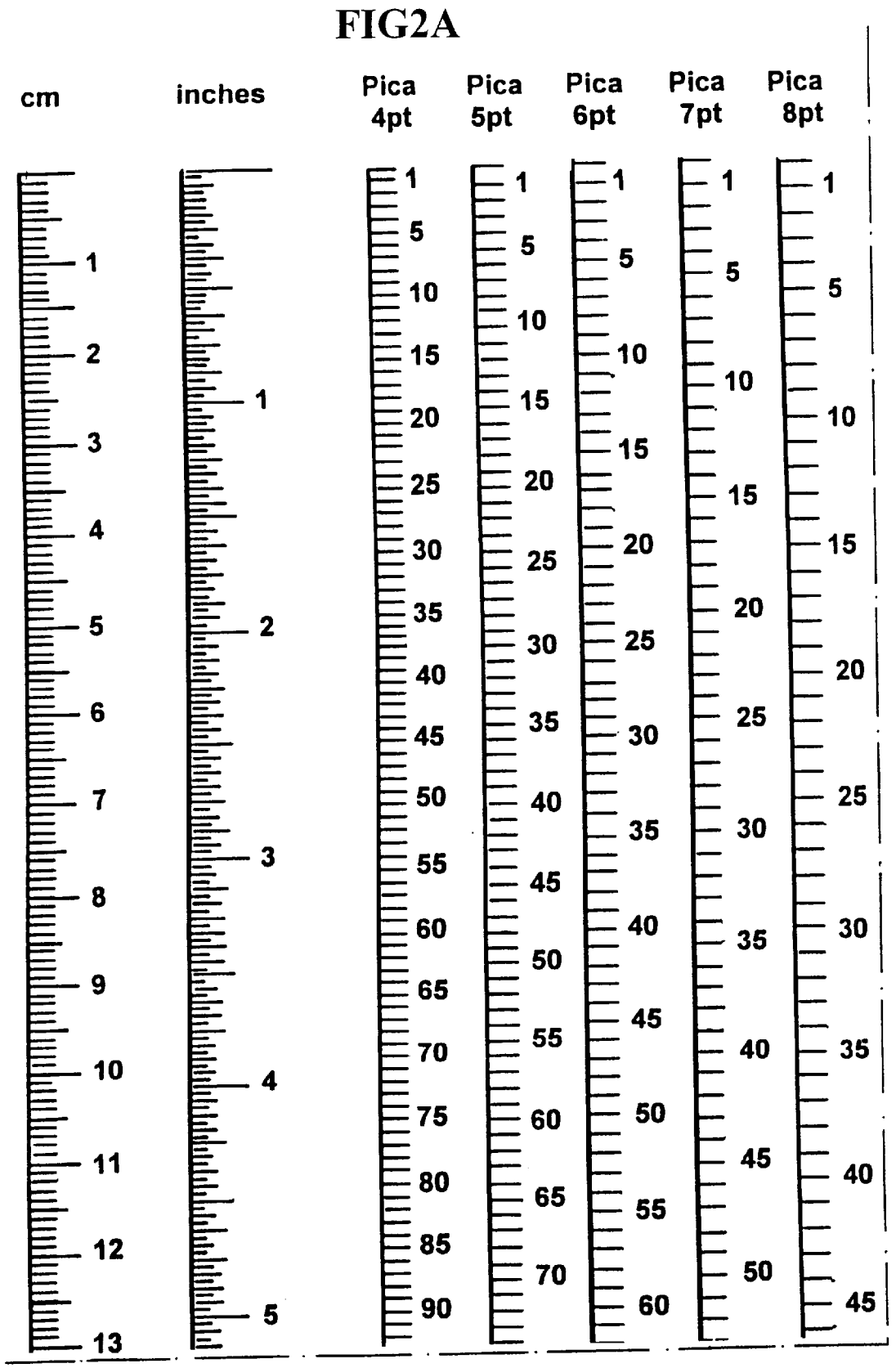
FIGS. 2A, 2B, 2C and 2D of the accompanying drawings which have been referred to above are top left, top right, bottom left and bottom right partial view of a reproduction of a similar image but made by a method according to the present invention.
Figure 2B:
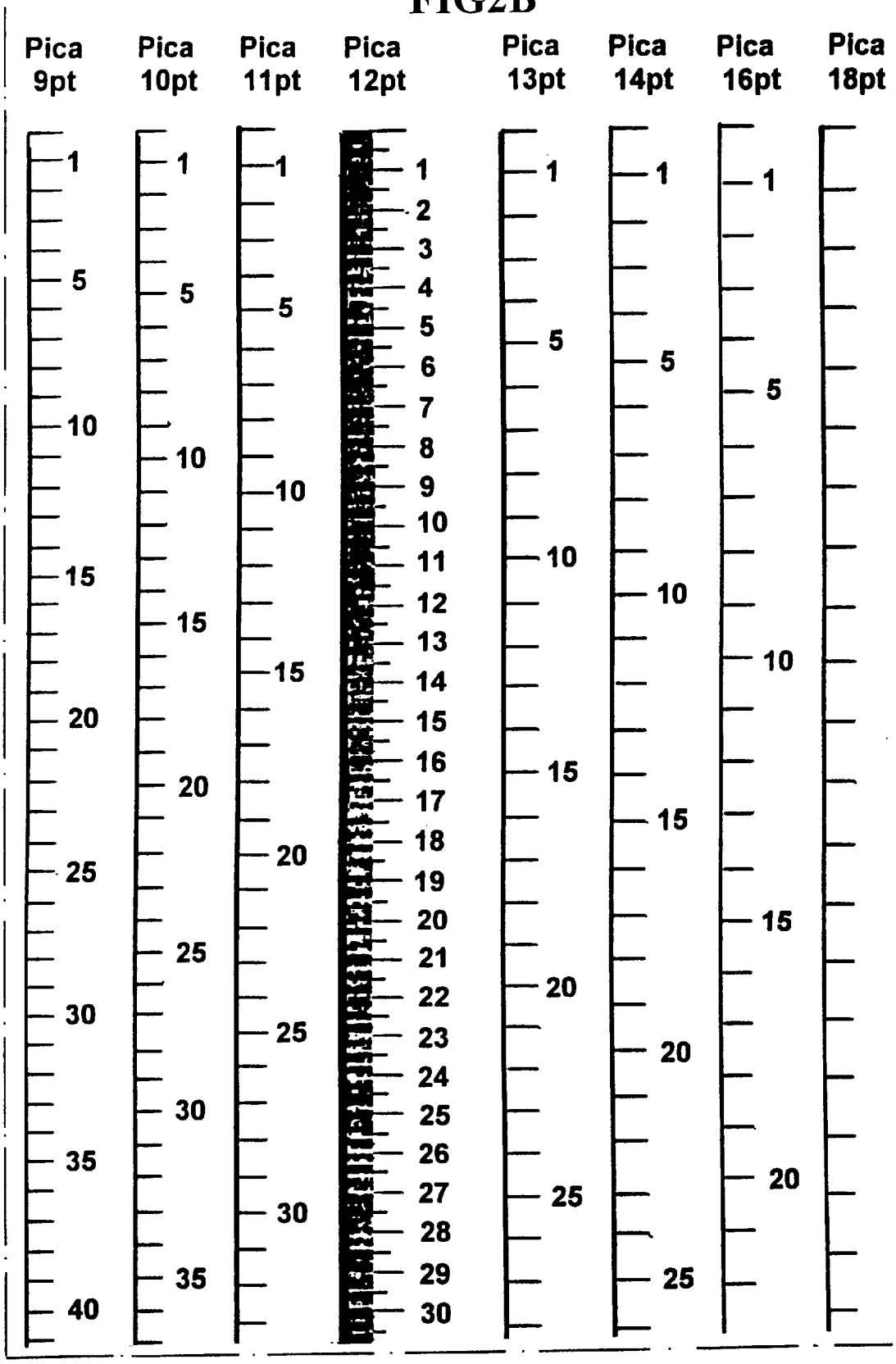
Figure 2C:
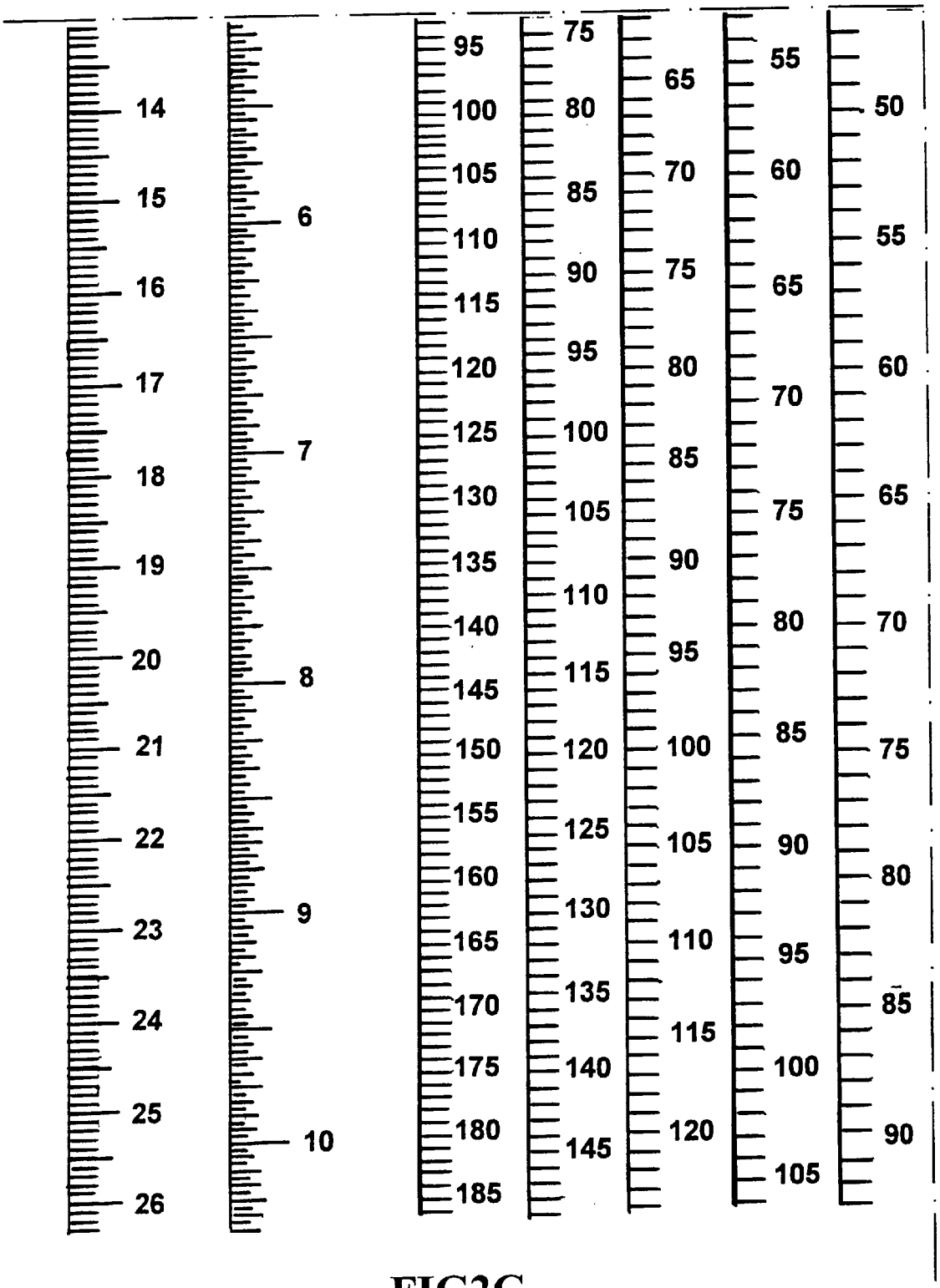
Figure 2D:
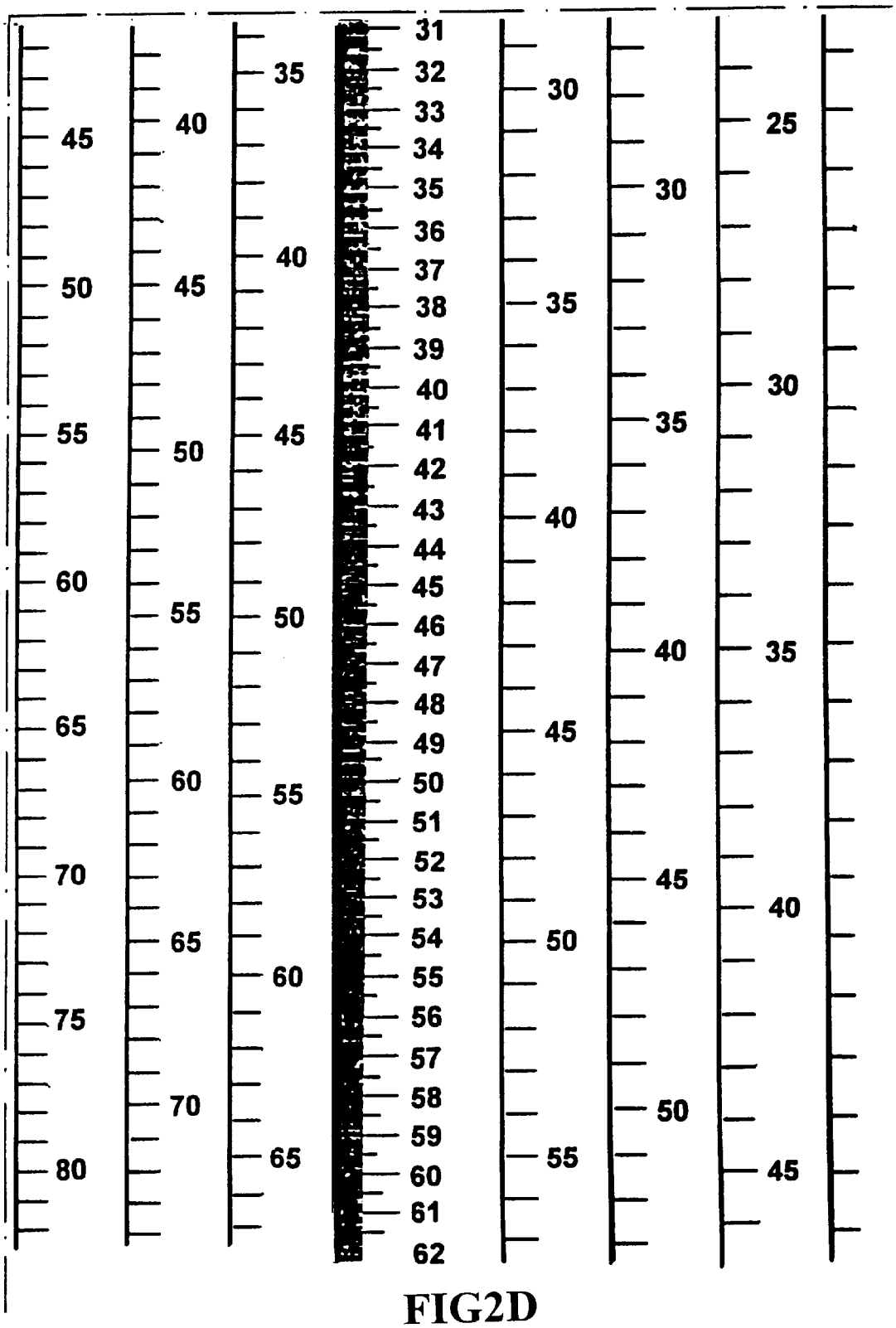

There now follows a detailed description of various methods according to the present invention which have been selected for description to illustrate the invention by way of example.

EXAMPLE 1

A full colour picture was placed in a xerographic colour copier (Canon model CLC 500) which was loaded with A4 90 gm/m$^2$ clay-coat craft paper provided on one surface with a solventless emulsion silicone coating of a general type such as is used in coating paper. A copy in the form of a right readable full colour image was formed on one surface of the paper, which might, for example, be the aforementioned CC90 paper supplied by I.S.O. Developments Limited.

The paper was then placed against an A4 sheet of 25 micron thick polyethylene naphthalate film form material ('Kaladex' 2000) with the toner image sandwiched between the paper and the film form material and the sandwich passed horizontally through a roller press (GMP Prolam 320 made by GMP of Seoul, Korea) at a speed of 5 cm/sec with the rollers preheated to a temperature of 150 degrees Celsius as measured by a Robin 3208K thermocouple Type K using a probe sensor which has been calibrated at 100 degrees Celsius. The sandwich was introduced to the press with the paper above the film. The rollers of the press are of 3.5 cms. diameter and are formed of a silicone rubber composition. The total transit time of the sandwich through the roller press was approximately 31 secs.

The heated sandwich was then allowed to cool for 5 seconds and the paper was then separated from the film form material. It was found that the toner image had been entirely transferred to the surface of the film as a mirror image of the original.

The film form material was then inspected to identify any extraneous matter that may have been trapped between the paper and the film, and such matter was removed.

Until the toner image was cooled to ambient temperature, the image on the film was handled with care to avoid inadvertent removal of any of the toner from the surface of the film.

When the toner had cooled sufficiently, the film was then placed against the surface of the substrate onto which the image was to be finally transferred. In this case the substrate was an A4 piece of stiff card having a gloss surface. The film and the card were placed in face to face relationship with the inverted image between them. The sandwich thus formed was then introduced to the roller press with the film on top of the card, and with the surface temperature of the rollers at 150 degrees Celsius. Again the transit time of the sandwich through the press was 31 seconds.

The sandwich was allowed to cool for five seconds and then the film was removed from the card. On eye inspection, it was found that the image had been entirely transferred to the surface of the card and that no parts of the image or particles of toner remained on the film.

EXAMPLE 2

A second copy of the original full colour picture used in Example 1 was formed on a second piece of A4 film form material, identical to the one described in Example 1, and the second piece of film form material ('Kaladex' 2000) was placed in register with the image formed on the card in Example 1, so that the two, identical, images were superimposed one precisely on top of the other. Determination of the proper register was made by eye.

The second piece of film and the card bearing the picture thereon were then passed through the roller press without changing the heating settings or rate of feed from those which were used in Example 1. The sandwich thus formed was then allowed to cool for five seconds and the film was then separated from the card. It was found that no particles or parts of the image remained on the film form material and that the colours of the picture on the card were considerably intensified.

EXAMPLE 3

A further copy of the original full colour picture used in Example 1 was formed on card as described in Example 1, and a further text image was formed on a further piece of A4 film form material ('Kaladex' 2000) as described in Example 1. The film form material and the card were then placed together with the text positioned on the picture as described. The sandwich so formed was then passed through the roller press used in the preceding Examples with the same temperature and feed rate conditions as before. When the sandwich had cooled, the film form material was removed from the card and the textual image was found to have been completely transferred onto the picture.

EXAMPLE 4

A first, full colour, textual, layout formed on a sheet of A4 size paper was placed in a xerographic colour copier (Canon model CLC 500) which was loaded with A4 90 gm/m$^2$ clay-coat craft paper provided on one surface with a solventless emulsion silicone coating. A copy in the form of a right readable full colour image was formed on one surface of the paper, which might, for example, be the aforementioned CC90 paper supplied by I.S.O. Developments Limited.

The paper was then placed against an A4 sheet of 25 micron thick polyethylene naphthalate film form material ('Kaladex' 2000) and the image transferred to the film form material in the manner described in Example 1.

A second, third and fourth layout, each identical to the first, were prepared and xerographic A4 sized copies made of each. Each copy was in turn placed against the film form material and the image thereon was transferred onto the film form material in the manner described in Example 1 so that the image formed on the film form material was successively built up by overlaying the respective layouts one on the other and side-by-side as the case may be. The layouts were transferred to the film form material in reverse order where overlay was intended so that those parts of the final picture to be created and which were intended to be dominant were applied to the film form material first.

The collective mirror image thus formed on the film form material was then transferred to the intended substrate in the manner described in Example 1 and inspection showed that full transfer of the image had taken place.

EXAMPLE 5

A full colour picture was placed in a xerographic colour copier (canon model CLC 500) which was loaded with A4 90 gm/m$^2$ clay-coat craft paper provided on one surface with a solventless emulsion silicone coating. A copy in the form of a right readable full colour image was formed on one surface of the paper, which might, for example, be the aforementioned CC90 paper supplied by I.S.O. Developments Limited.

The image was then transferred to 25 micron thick polyethylene naphthalate film form material ('Kaladex' 2000) in the manner described in Example 1.

The film form material was then placed against an A4 sheet of metallised film form material and the sandwich so formed was passed through a roller press of the type described in Example 1 under the same conditions of use. The image on the film was fully transferred to the metallised film which changed the background colour characteristics of the images.

EXAMPLES 6, 7 and 8

Each of the Examples 1, 4 and 5 was repeated using A4 140 gm/m$^2$ clay-coat craft paper provided on one surface with a solventless emulsion silicone coating, which might, for example, be the aforementioned CC140 paper supplied by I.S.O. Developments Limited. It was found that the results that were achieved were of the same quality as when 90 gm/m$^2$ clay-coat craft paper was used.

It will be appreciated from the preceding Examples that a method according to the present invention can be carried out to provide a number of various effects. In addition to the examples disclosed, it is possible to produce multiple images and to use those multiple images as desired.

In addition to the Examples given above, further tests were carried out, for each of the Examples given, in which textual images were superimposed upon the resultant image of each Example before the final image was transferred to a substrate surface. In each case, the quality of definition and evenness of colour of the textual matter was found to be as good as with conventional printing techniques, regardless of the colour of the textual image.

With images formed in accordance with each of the above Examples and as set forth in the last preceding paragraph, it has been possible to transpose the final image onto a number of surfaces, including card, cardboard, glass, paper, wood, metal, metallised materials, plastics materials, film form materials and fabrics and textile materials. Using heating means, principally a roller press of the type referred to above, or a larger version thereof, as dictated by the size of the substrate onto which images were to be finally transferred, it has been possible to carry out both the heating steps of a method according to the present invention and thus to transfer full colour images onto cardboard box blanks in a single step, while, using a portable heating device such as a single heated roller, it has been possible to transfer full colour images directly onto fitted glass windows. In each case, once the transferred image was allowed to cool, it was found to be firmly adhered to the surface onto which it had been transferred.

The above embodiments of this invention have been described by way of example only and a wide range of further variations are possible without departing from the scope of the invention. Thus, whilst this description has been principally confined to the use of colour photocopiers, the invention has application with toner based images formed in other ways, such as with laser printers or any particularly convenient method of applying the necessary heat and pressure. Where other types of photocopiers operate with different proprietary toner materials having different temperature characteristics from one another (while the stability and desired characteristics of the polyethylene naphthalate film form material are optimum within the aforesaid range of temperature of 140–160 degrees Celsius), this problem of temperature differences can be overcome by ensuring that the initial image copy is made at the desired temperature range, or is copied subsequently at that temperature range to provide the working image.

The invention has also been performed using xerographic colour copiers other than the Canon model CLC 500, including a range of colour copiers from Xerox Corporation. The same results were achieved as with the Canon copier.

It is a feature of the preferred form of the invention that a range of transfer and enhancement processes can be carried out with the same heating and pressure equipment. It will be possible, however, to apply heat and pressure in other ways such as a heated press or a combination of cold rollers or presses and a source of radiant heat such as halogen lamps.

What is claimed is:

1. A method of printing monochrome and full colour images onto a surface having a continuous surface, the method comprising the steps of (a) transferring the image onto a first image carrier to provide a toner image on the first image carrier, (b) placing the first image carrier against a second image carrier with the toner image between the first image carrier and the second image carrier, the second image carrier having a greater affinity for the toner than the first image carrier when the toner is heated and being formed from a material selected from the group consisting of a film form polyethylene ester material having a thermal shrinkage characteristic of less than 1% or a film form polyimide material;

(c) heating the first and second image carriers, with the toner image therebetween, under pressure;

(d) thereafter removing the first image carrier from the second image carrier, with the toner image wholly transferred to the second image carrier;

(e) placing the second image carrier against a surface of a substrate, onto which the toner image is to be ultimately transferred, with the toner image therebetween, the substrate having a greater affinity for the toner than the second image carrier;

(f) heating the second image carrier and the substrate, with the toner image therebetween, under pressure;

(g) thereafter removing the second image carrier from the substrate, with the toner image transferred to the substrate; and (h) enhancing the toner image after transfer to the substrate.

2. A method according to claim 1, in which the enhancement is effected by deposition of material from film-form materials.

3. A method according to claim 2, in which the film-form material comprises a carrier film with a coating of clear heat-activated release agent supporting the enhancing material to be deposited, heat and pressure being applied to transfer the enhancing material from the carrier film to the toner image.

4. A method according to claim 3, in which the film-form material comprises:

i) a polyester carrier film;

ii) clear heat-activated release agent;

iii) clear lacquer;

iv) at least one pigment layer; and v) heat-activated adhesive.

5. A method according to claim 1, in which a color toner image is generated from the output of a monochrome printing or copying process by the deposition of successive pigment layers on the toner image.

6. A method according to claim 1, in which the toner image is enhanced by deposition thereon of metal from a metallic foil.

7. A method according to claim 6, in which the metallic foil comprises:

i) a polyester carrier film;

ii) clear heat-activated release agent;

iii) translucent colored lacquer;

iv) vacuum deposited aluminum; and v) heat-activated adhesive.

8. A method according to claim 1, in which the toner image is enhanced by deposition of a lacquer coating.

9. A method according to claim 8, in which the lacquer coating is deposited from a foil comprising:

i) polyester carrier film;

ii) clear heat-activated release agent;

iii) clear lacquer; and iv) heat-activated adhesive.

10. A method according to claim 8, in which the lacquer comprises translucent dye material.

11. A method of printing monochrome and full color images onto a surface having a continuous surface, the method comprising the steps of (a) transferring the image onto a first image carrier to provide a toner image on the first image carrier, (b) placing the first image carrier against a second image carrier with the toner image between the first image carrier and the second image carrier, the second image carrier having a greater affinity for the toner than the first image carrier when the toner is heated and being formed from a material selected from the group consisting of a film form polyethylene ester material having a thermal shrinkage characteristic of less than 1% or a film form polyimide material;

(c) heating the first and second image carriers, with the toner image therebetween, under pressure;

(d) thereafter removing the first image carrier from the second image carrier, with the toner image wholly transferred to the second image carrier;

(e) placing the second image carrier against a surface of a substrate, onto which the toner image is to be ultimately transferred, with the toner image therebetween, the substrate having a greater affinity for the toner than the second image carrier;

(f) heating the second image carrier and the substrate, with the toner image therebetween, under pressure;

(g) thereafter removing the second image carrier from the substrate, with the toner image transferred to the substrate; and (h) enhancing the toner image when on the first image carrier by deposition of material on top of the toner image to form a backing layer when transferred to the substrate.

12. A method according to claim 11, which includes depositing a white backing layer.

13. A method according to claim 11, which includes depositing black material upon regions of black toner image.

14. A method according to claim 11, in which the material is deposited from a foil comprising:

i) polyethylene ester carrier film;

ii) clear heat-activated release agent;

iii) at least one pigment layer; and iv) heat-activated adhesive.

15. A method of printing monochrome and full color images onto a surface having a continuous surface, the method comprising the steps of (a) transferring the image onto a first image carrier to provide a toner image on the first image carrier, (b) placing the first image carrier against a second image carrier with the toner image between the first image carrier and the second image carrier, the second image carrier having a greater affinity for the toner than the first image carrier when the toner is heated and being formed from a material selected from the group consisting of a film form polyethylene ester material having a thermal shrinkage characteristic of less than 1% or a film form polyimide material;

(c) heating the first and second image carriers, with the toner image therebetween, under pressure;

(d) thereafter removing the first image carrier from the second image carrier, with the toner image wholly transferred to the second image carrier;

(e) placing the second image carrier against a surface of a substrate, onto which the toner image is to be ultimately transferred, with the toner image therebetween, the substrate having a greater affinity for the toner than the second image carrier;

(f) heating the second image carrier and the substrate, with the toner image therebetween, under pressure;

(g) thereafter removing the second image carrier from the substrate, with the toner image transferred to the substrate; and (h) applying a pigment or metallic layer to the target substrate prior to the transfer of the toner image thereto.

16. A method according to claim 15, in which the pigment or metallic layer is deposited form a base foil using masking to limit the deposition to predetermined regions of the substrate.

* * * * *